US005555862A

United States Patent [19]

Tozzi

[11] Patent Number: 5,555,862

[45] Date of Patent: Sep. 17, 1996

[54] SPARK PLUG INCLUDING MAGNETIC FIELD PRODUCING MEANS FOR GENERATING A VARIABLE LENGTH ARC

[75] Inventor: Luigi P. Tozzi, Columbus, Ind.

[73] Assignee: Cummins Engine Company, Inc., Columbus, Ind.

[21] Appl. No.: 277,197

[22] Filed: Jul. 19, 1994

[51] Int. Cl.[6] ..... F02P 23/00

[52] U.S. Cl. ..... 123/143 B

[58] Field of Search ..... 313/141, 142, 313/143, 144; 123/169 EL, 143 B; 315/58

[56] References Cited

U.S. PATENT DOCUMENTS

| | | | |
|---|---|---|---|
| 3,219,866 | 11/1965 | Dingman | 313/141 |
| 3,639,635 | 2/1972 | Lee | 313/143 X |
| 3,866,074 | 2/1975 | Smith | 313/141 X |
| 3,967,149 | 6/1976 | Eaton et al. | 313/141 |
| 4,029,990 | 6/1977 | Nagy et al. | 313/141 X |
| 4,059,782 | 11/1977 | Lentz | 313/141 X |
| 4,122,816 | 10/1978 | Fitzgerald et al. | 123/143 B |
| 4,366,801 | 1/1983 | Endo et al. | 123/620 |
| 4,369,756 | 1/1983 | Ezoe | 123/620 |
| 4,369,758 | 1/1983 | Endo . | |
| 4,388,549 | 6/1983 | Bensman | 313/143 X |
| 4,396,854 | 8/1983 | Weinberg | 313/143 X |
| 4,396,855 | 8/1983 | Imai et al. | 313/141 X |
| 4,407,259 | 10/1983 | Abo . | |
| 4,433,669 | 2/1984 | Ishikawa et al. . | |
| 4,448,181 | 5/1984 | Ishikawa et al. . | |
| 4,471,732 | 9/1984 | Tozzi | 123/143 B |
| 4,487,192 | 12/1984 | Anderson et al. | 313/140 X |
| 4,493,297 | 1/1985 | McLlwain et al. | 123/143 B |
| 4,510,915 | 4/1985 | Ishikawa et al. . | |
| 4,636,690 | 1/1987 | Herden et al. | 313/142 X |
| 4,713,582 | 12/1987 | Yamada et al. | 313/118 |
| 4,760,820 | 8/1988 | Tozzi | 123/143 B |
| 4,766,855 | 8/1988 | Tozzi | 123/143 B |
| 4,774,914 | 10/1988 | Ward . | |
| 4,777,925 | 10/1988 | LaSota . | |
| 4,787,360 | 11/1988 | Filippone . | |
| 4,821,925 | 6/1989 | Ward | 123/143 B |
| 4,826,462 | 5/1989 | Lenk | 445/7 |
| 4,850,316 | 7/1989 | Pasbrig | 313/125 X |
| 4,892,070 | 1/1990 | Kuhnert . | |
| 4,903,675 | 2/1990 | Huntzinger et al. . | |
| 4,996,967 | 3/1991 | Rosswurm et al. . | |
| 5,034,718 | 7/1991 | Weisser et al. | 338/64 |
| 5,113,806 | 5/1992 | Rodart | 123/143 B |
| 5,143,042 | 9/1992 | Scheid . | |
| 5,168,858 | 12/1992 | Mong . | |
| 5,256,036 | 10/1993 | Cole | 123/143 B |
| 5,272,415 | 12/1993 | Griswold et al. | 315/58 |

FOREIGN PATENT DOCUMENTS

WO93/10348 5/1993 WIPO .

*Primary Examiner*—Raymond A. Nelli

*Attorney, Agent, or Firm*—Woodard, Emhardt, Naughton, Moriarty & McNett

[57] ABSTRACT

A variable length arc magnetic spark plug includes a shell, a pair of electrodes that define a variable length air gap or diverging air gap therebetween, and at least one magnet that produces a magnetic field in the air gap separating the electrodes. The magnitude of an ignition signal supplied to the electrodes directly affects the force acting on the arc to move or position the arc relative to the magnetic field produced by the magnets in accordance with well known field principles. In the preferred embodiment, a pair of magnets produces a magnetic field in the diverging air gap. Less current is required to produce a larger or longer arc with the inclusion of the magnets in the vicinity of the air gap wherein the electrical arc is generated.

10 Claims, 12 Drawing Sheets

SPARK PLUG INCLUDING MAGNETIC FIELD PRODUCING MEANS FOR GENERATING A VARIABLE LENGTH ARC

BACKGROUND OF THE INVENTION

1. Field of the Invention

This invention relates to spark plugs in general and more particularly to spark plugs for use in internal combustion engines.

2. Background of the Invention

A conventional spark plug includes a metallic shell adapted to be fitted into an opening of an engine wherein an air-fuel mixture is present. This area is typically referred to as a cylinder or combustion chamber within the engine. The shell of the spark plug accommodates a ceramic or other insulating structure through which an electrode extends into the combustion chamber. One end of the electrode is connected to an ignition system that supplies an high energy signal to the spark plug, and the other end of the electrode terminates within the combustion chamber. The spark plug provides an electrical arc or spark required to initiate combustion of the air-fuel mixture within the combustion chamber. A ground electrode (typically a projection or protrusion extending inward from the shell of the spark plug) is disposed in spaced apart relation with the electrode and provides a gap across which a high energy arc is established via the ignition system of the engine. The ground electrode or protrusion is mechanically displaced so that a predetermined distance or air gap is established between the center electrode and the ground electrode.

In systems well-known in the art, the spark plug of an internal combustion engine includes a predetermined spark gap or air gap which is mechanically adjusted prior to installation of the spark plug into a corresponding receptacle of the engine. Normally, the spark gap is adjusted to a length between 0.025 inches and 0.060 inches to provide an arc or spark having desired characteristics necessary for initiating proper combustion of the air-fuel mixture. When the engine is cold, it is more difficult to generate a spark between the electrode and the ground projection than is the case when the engine is hot. Further, it is well known that high load conditions require a small spark gap, where as low load conditions require a larger spark gap for proper combustion of the air-fuel mixture to take place.

DESCRIPTION OF THE PRIOR ART

Pratt, Jr., U.S. Pat. No. 3,974,412, discloses a spark plug wherein the path and consequently the length of the arc discharge is varied by virtue of the repulsion of two oppositely directed electric currents. The result is an arc whose length is much longer than ordinarily obtainable. Varying the current supplied to the arc results in a radial force useful in moving the arc in a radial direction with respect to the electrode and ground potential structures.

Dibert, U.S. Pat. No. 4,906,889, discloses a spark plug having an electrode which is grooved to enlarge its area and enable a ground projection or wire to react like a bimetallic element in response to changes in combustion chamber temperatures to vary the length of the spark gap.

Pratt, Jr., U.S. Pat. No. 4,087,719, discloses a spark plug wherein corona discharge is employed to create a long arc and to determine the path of the arc. Electrode and ground potential surfaces are oriented so that a radial force is provided to the are to encourage the arc to grow or increase its length. The arc created is generally parallel with the electrode of the spark plug.

Almquist et al., U.S. Pat. No. 4,046,127, discloses a spark plug structure wherein engine vacuum levels or engine temperature provide a basis for adjusting the length of a spark or arc. The arc is varied in length between two electrodes by a third electrode situated near the two electrodes and movable with respect thereto. The third electrode is displaced or moved to mechanically shorten or lengthen the spark gap according to sensed temperature or vacuum levels.

Dingman, U.S. Pat. No. 3,219,866, discloses a spark plug structure having diverging gap electrodes disposed between two magnetic pole pieces to produce a directional advance of an arc therebetween.

Tozzi, U.S. Pat. Nos. 4,471,732 and 4,760,820, disclose a plasma jet plug structure including a plasma medium for generating a plasma and discharging the plasma as a jet into the combustion chamber of an internal combustion engine under the accelerating influence of a magnetic field.

Tozzi, U.S. Pat. No. 4,766,855, discloses a plasma jet plug structure similar to U.S. Pat. Nos. 4,471,732 and 4,760,820, and further includes an orifice for accelerating the plasma out of the plug cavity, under the influence of an accelerating magnetic field, with a ring vortex structure.

It has been determined that low ignition density conditions require a larger arc to provide sufficient ignition energy (approximately 17 milliJoules) to be discharged across the gap and promote proper combustion. Conversely, high ignition densities require smaller arcs (or arcs having a lower energy requirement). Therefore, less energy should be discharged into the spark gap under high ignition density conditions to avoid excessive voltages (in excess of 30,000 volts) which may be in excess of the dielectric capability of the high voltage harness of the internal combustion engine.

Thus, a spark plug device including a variable length spark gap that results in improved combustion stability at low loads and yet provides a small spark gap for high loads in the operation of a lean burn internal combustion engine is needed.

SUMMARY OF THE INVENTION

A plasma ignition apparatus for generating plasma and for propelling the plasma from the ignition apparatus according to one aspect of the present invention comprises insulation means defining a cavity, electrical energy discharge means cooperatively arranged with the cavity and arranged for generating an electrical energy discharge in the cavity, the electrical energy discharge being at a level sufficient to generate plasma within the cavity and below a level at which the generated plasma is propelled from the cavity and capable of ignition external to the cavity, the discharge means including a first electrode means situated within the cavity and a second electrode means situated within the cavity and in close proximity with the first electrode means, the first and second electrode means defining a diverging gap therebetween, and magnetic field generation means establishing a magnetic field within the cavity in the diverging gap, the magnetic field providing a supplemental propelling force on the generated plasma, the magnetic field generation means being situated so that the insulation means provides an electrical insulator between the electrical energy discharge means and the magnetic field generations means.

According to another aspect of the present invention, a plasma ignition apparatus for generating plasma and for propelling the plasma from the ignition apparatus comprises insulation means defining a cavity, electrode means arranged relative to the cavity for discharging electrical energy in the cavity at a level sufficient to generate plasma at a predetermined location within the cavity and capable of ignition external to the cavity, the electrode means defining a diverging air gap wherein the plasma is generated, a magnetic field generation means for establishing a magnetic field within the cavity, the magnetic field generation means situated in close proximity to the cavity yet electrically insulated therefrom by the insulation means, and control means providing energy to the electrode means to create a current and voltage level sufficient to induce an electrical discharge in the diverging air gap.

According to a further aspect of the present invention, a spark plug device comprises a non-conductive substantially cylindrical shell, the shell including a first end and a second end, the first end defining a cavity therein, a first electrode situated within the cavity, a second electrode situated within the cavity, magnetic field generating means attached to the shell near the cavity and producing a magnetic field, that, in conjunction with current flowing between the first and second electrode, urges a plasma arc established between the first and second electrodes in an outwardly direction from within the cavity, and wherein the shell provides electrical insulation between the first and second electrodes and the magnetic field generating means, and further wherein the first and second electrodes define a diverging gap within the cavity.

One object of the present invention is to provide an improved spark plug having a small divergent gap.

Another object of the present invention is to produce a variable length arc in accordance with engine operating conditions that require a particular size arc.

Yet another object of the present invention is a variable length arc spark plug that is compatible with the electrical characteristics of most well known ignition system.

A further object of the present invention is to provide means for electrically insulating the magnets from the electrodes, the insulating means further thermally insulating the magnets and conducting heat away from the magnets.

A still further object of the present invention is to provide a heat sinks means around the magnets to transfer heat from the electrical/thermal insulation means to the metallic outer shell.

An additional object of the present invention is to provide a protective membrane affixed to, and sealing, the plug cavity to prevent ferro magnetic particles from contaminating the plug cavity during manufacture, handling and installation.

Yet a further object of the present invention is to provide a resistive electrode with a predetermined resistance to reduce electronic interference.

These and other object of the present invention will become more apparent from the following description of the preferred embodiment.

DESCRIPTION OF THE PREFERRED EMBODIMENT

Figure 1:
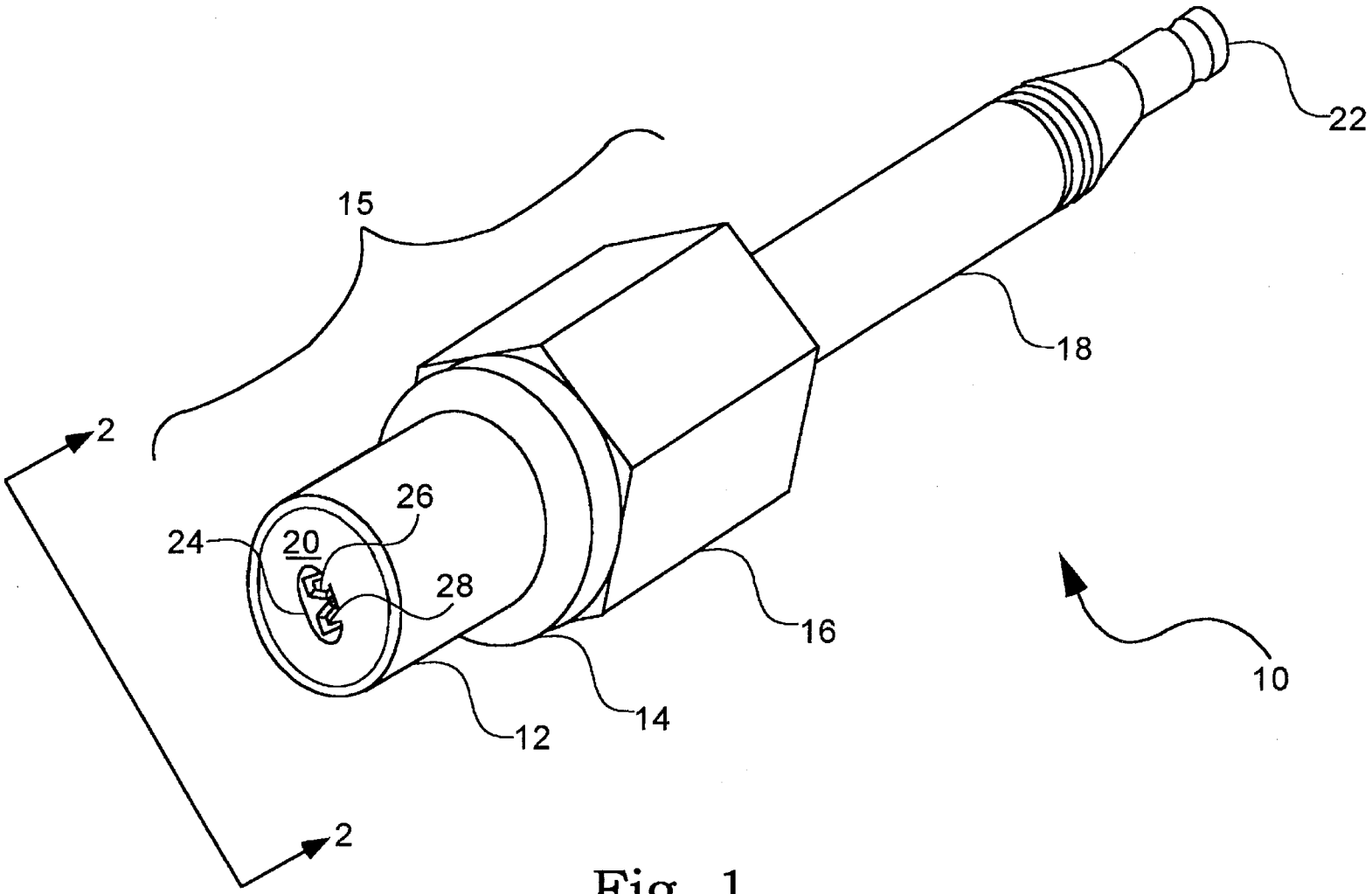
FIG. 1 is an isometric view of a variable length arc magnetic spark plug according to-the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a magnetic spark plug 10 according to the present invention is shown. Spark plug 10 includes a threaded portion 12 including external threads sized to match those normally found in a cylinder head or cylinder block wherein a typical spark plug is received in an internal combustion engine (not shown). Collar 14 engages the surface of a cylinder head or cylinder block to provide a tight seal when spark plug 10 is threaded into the head or cylinder of an engine. Hexagonal portion 16 provides mechanical interface for engaging a spark plug socket for insertion or removal of spark plug 10. Normally, threaded portion 12, collar 14, and hexagonal portion 16 are formed from a single piece of metal in the construction of a typical spark plug shell or housing 15 well known in the art. Insulator 18 is attached to hexagonal portion 16 and to insulator 20. Insulator 20 extends internally through the threaded portion 12, collar 14, and hexagonal portion 16 to engage insulator 18. Insulators 18 and 20 may be joined using any of various well known mechanical joining techniques including adhesives, fasteners, etc. It is contemplated that insulator 18 and 20 may be formed in a single piece using ceramic materials well known in the art or an alternative material known as silicon nitride. Terminal 22 is connected to a source of high energy, typically the ignition system of the internal combustion engine. A high voltage signal is applied to terminal 22 in order to generate an arc in the cavity 24 wherein electrodes 26 and 28 are situated. Electrode 26 is connected internally to the housing 15.

Figure 2:
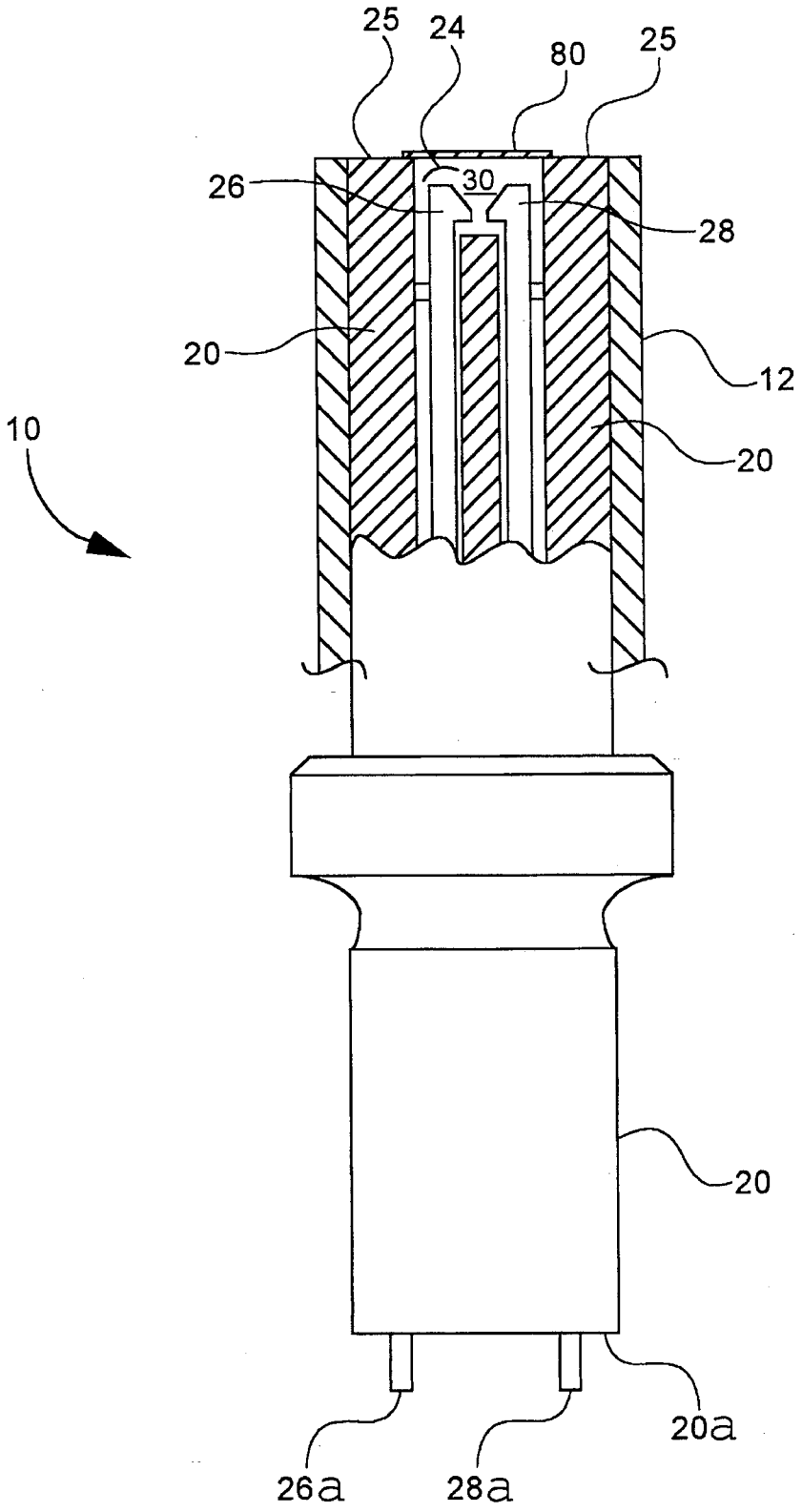
FIG. 2 is a partial cross-sectional/partial cutaway view of the spark plug of FIG. 1.

Referring now to FIG. 2, a partial cross-sectional view of the spark plug 10 along the section lines 2—2 shown in FIG. 1 reveals the internal configuration of the insulator 20 and the electrodes 26 and 28 within cavity 24. The threaded portion 12 is shown so that a complete understanding of the mechanical configuration of the spark plug may be realized. Electrodes 26 and 28 extend internally along the entire length of insulator 20 and emerge at the distal end 20*a*. Electrode 26*a* is a portion of and corresponds with electrode 26 and likewise electrode 28*a* corresponds with electrode 28. Electrode 26*a* is typically connected to the housing 15 and electrode 28*a* is connected to the terminal 22 shown in FIG. 1. These electrical connections provide a signal path through which current is delivered to the air gap 30 between electrodes 26 and 28.

A protective membrane 80 is attached to the end 25 of the insulator 20 to seal cavity 24, thereby preventing ferro magnetic particles from contaminating the cavity 24 during handling and installation. The membrane 80 is dissolved during the first engine cycle due to the temperature and pressure generated by the compression stroke and therefore does not inhibit plug operations. Although a variety of materials may be used for membrane 80, the material must be volatile and combustible. Ideally, membrane 80 is a fuel which dissipates upon combustion, and in a preferred embodiment is made of paraffin and attached to the end 25 of insulator 20 by any commonly known method.

Figure 3A:
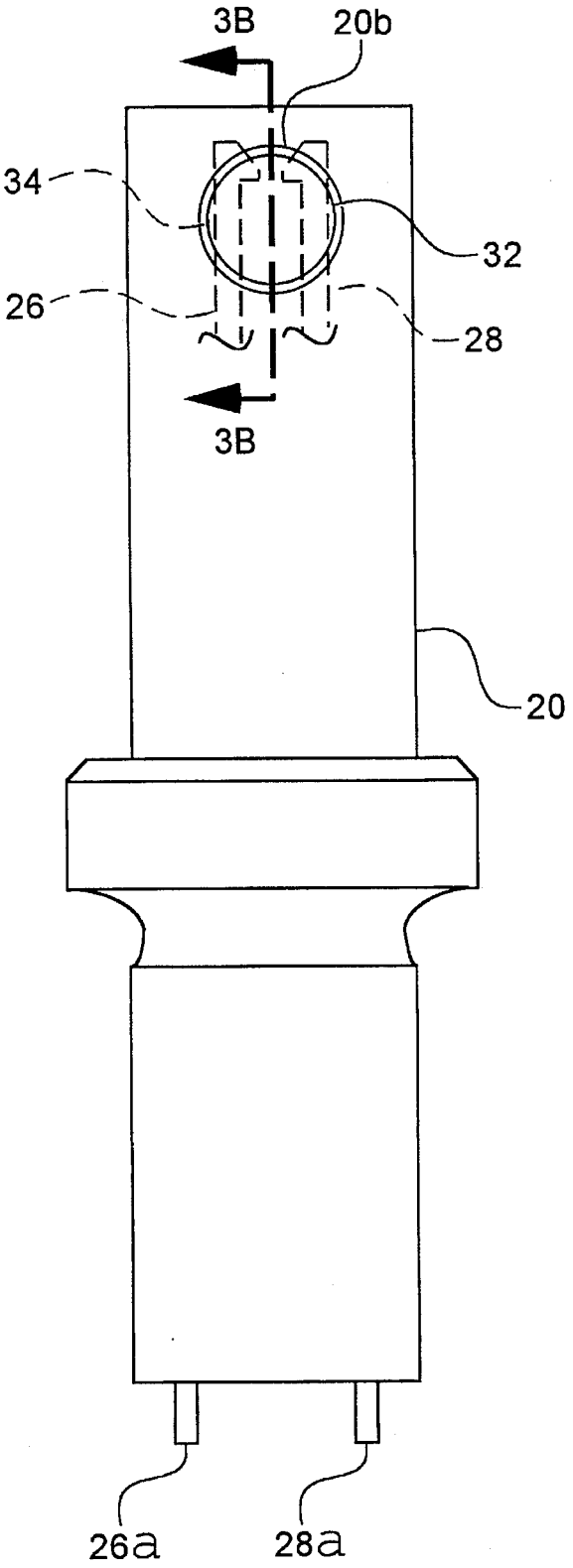
FIG. 3A is a front view of the dielectric insert shown in FIG. 2.
Figure 3B:
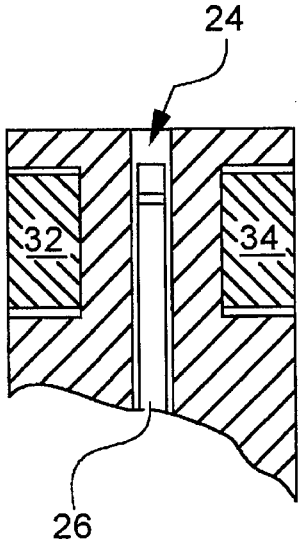
FIG. 3B is a cross-sectional/partial cutaway view of the dielectric insert of FIG. 3A along section lines *3b—3b*.

Referring now to FIGS. 3*a* and 3*b*, the insulator 20 is shown in two different views, including a cross-sectional/partial cutaway view along section lines 3*b*—3*b*. Identical magnets 32 and 34 are also shown as situated on opposite sides of insulator 20, as shown in FIG. 3*b*, so that electrodes 26 and 28 are essentially "sandwiched" between two magnets. A magnetic field is thereby established radially across insulator 20 in the area of the air gap 30 shown in FIG. 2. The strength of the magnetic field is dependent on several factors including the size, composition and distance between magnets 32 and 34. The polarity of the magnets is arranged so that the arc is propelled outwardly from the cavity 24. A view of the opposite side of insulator 20 is identical to that shown in FIG. 3*a* with the exception of the swapping of electrodes 26 and 28 in relative position.

Figure 4:
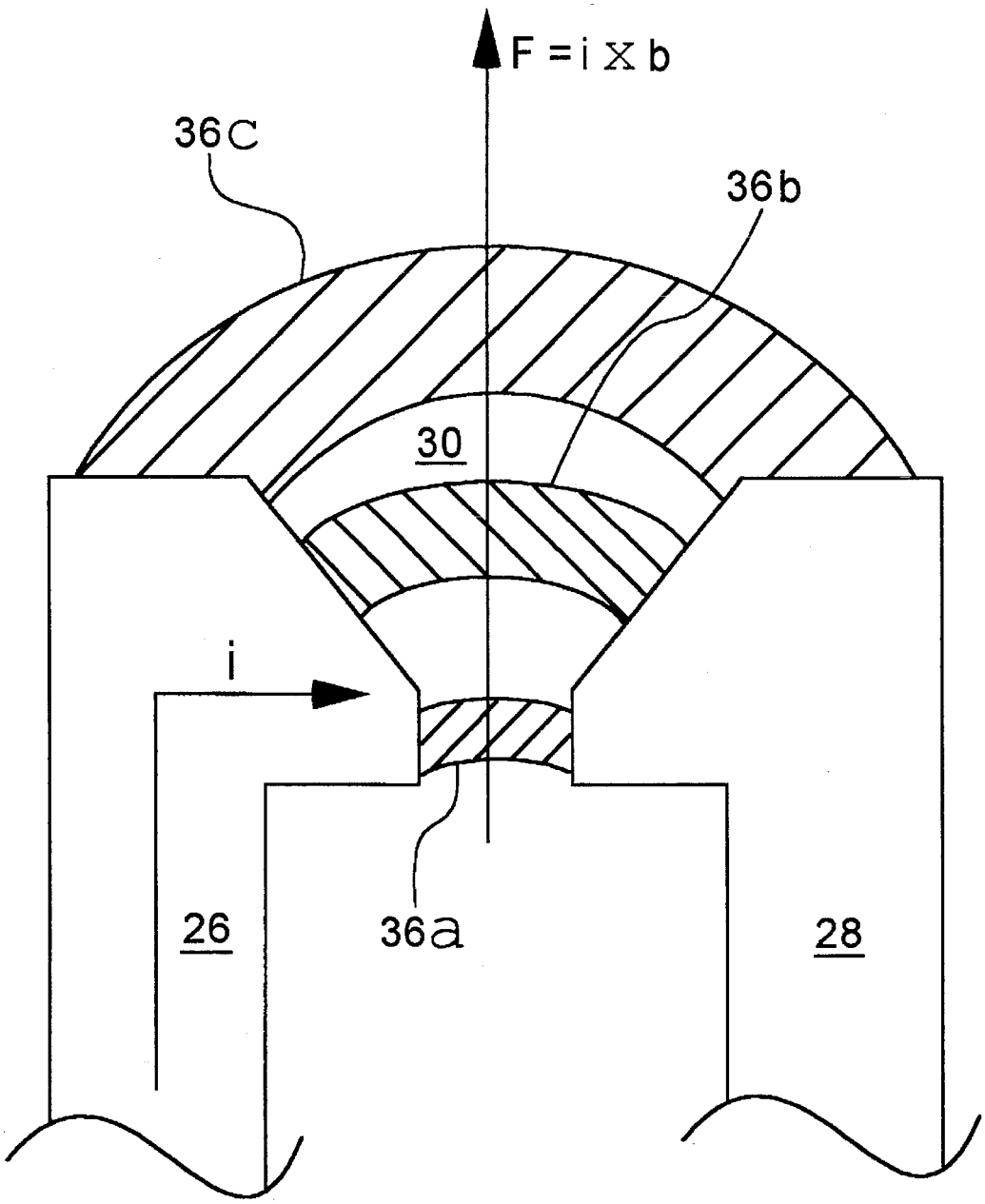
FIG. 4 is an enlarged view of the electrodes shown in FIG. 2 depicting the flow of current and the Lorentz force vector as well as the position of an arc produced in accordance with various current levels.

Referring now to FIG. 4, an enlarged view of electrodes 26 and 28 is shown. Various arcs 36*a–c* are shown to depict the relative position of an arc created and established between electrodes 26 and 28 in accordance with various power levels of ignition signals delivered to terminal 22 of FIG. 1. In particular, the arc 36*a* is established when a breakdown of the molecules between electrodes 26 and 28 occur, generating a plasma area wherein current flow is established between electrodes 26 and 28. The plasma contains ions which enable or provide a conduit for an electrical signal to flow. Once the resistance of the air gap is broken down in the gap 30, the voltage required to sustain an arc between the electrodes typically falls off from the voltage required to establish the arc.

In order to encourage or force the arc 36*a* to move to a position designated by the arc 36*c*, an increase in the level and duration of current i flowing into electrode 26 is required. The advantage of producing arc 36*c* is realized when alternate fuel engines are implemented in a vehicle. Alternate fuel engines, particularly liquid propane or natural gas engines, on occasion require turbocharging in order to fully utilize the capabilities of such an engine. In using a turbocharger with such an engine, pressures within the engine cylinder vary widely from a high load engine condition to a light load or idle condition. Therefore, it is desired that the arc produced in the gap 30 be situated at location 36*c* under idle or low power conditions. Under high power conditions and high load, the arc at 36*a* is preferred. The arc at 36*b* is shown to illustrate the fact that depending upon the level and duration of current i supplied to electrode 26, the position of the arc established in the air gap 30 can be controlled.

Inclusion of magnets 32 and 34 significantly reduces the amount of current required to position the arc 36*c* between electrodes 26 and 28. Current reduction in an order of magnitude of approximately 1,000 is experienced by using rare earth magnets (32 and 34) made of sumarium cobalt to produce a magnetic field in the air gap 30. The force vector depicted in FIG. 4 as F, is a graphical depiction of the Lorentz force vector acting on arc 36*a–c* in accordance with the formula i×B. The diverging gap defined by electrodes 26 and 28 provides a means for establishing a variable length arc in a spark plug device. The most significant achievement is the reduction in the amount of current required to establish the arcs 36*a–c*. With the spark plug 10 according to the present invention, an ignition system found on most all vehicles is compatible with and capable of providing or producing any of the arcs 36*a*–36*d*.

Figure 5A:
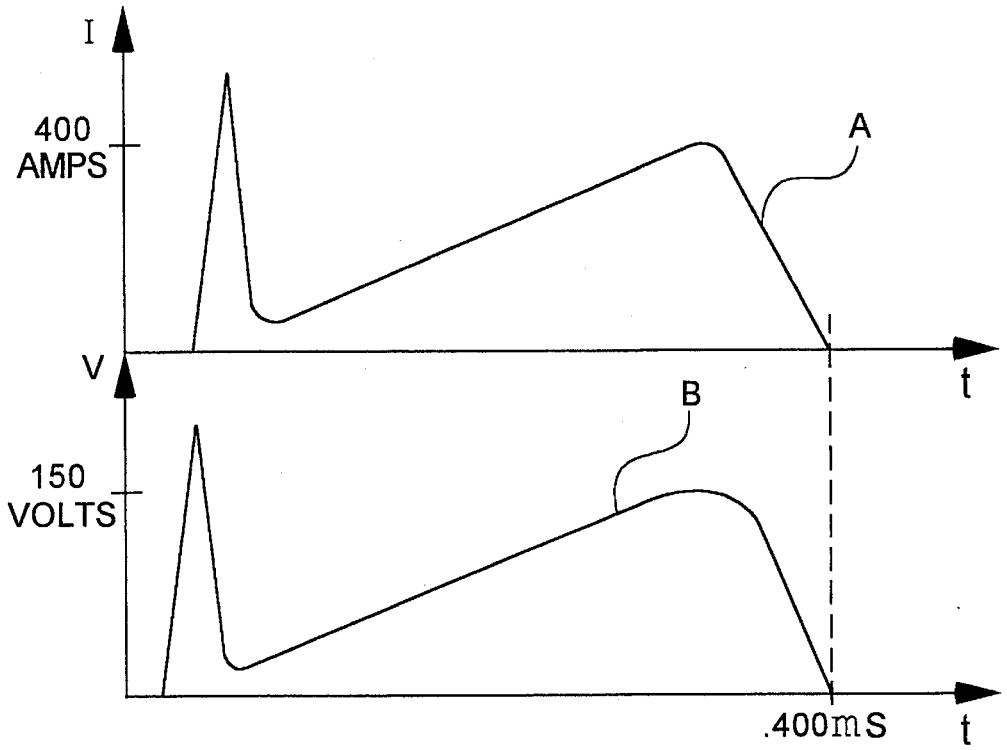
FIG. 5A is a chart depicting a high power spark voltage and current curve required by prior art spark plug devices.
Figure 5B:
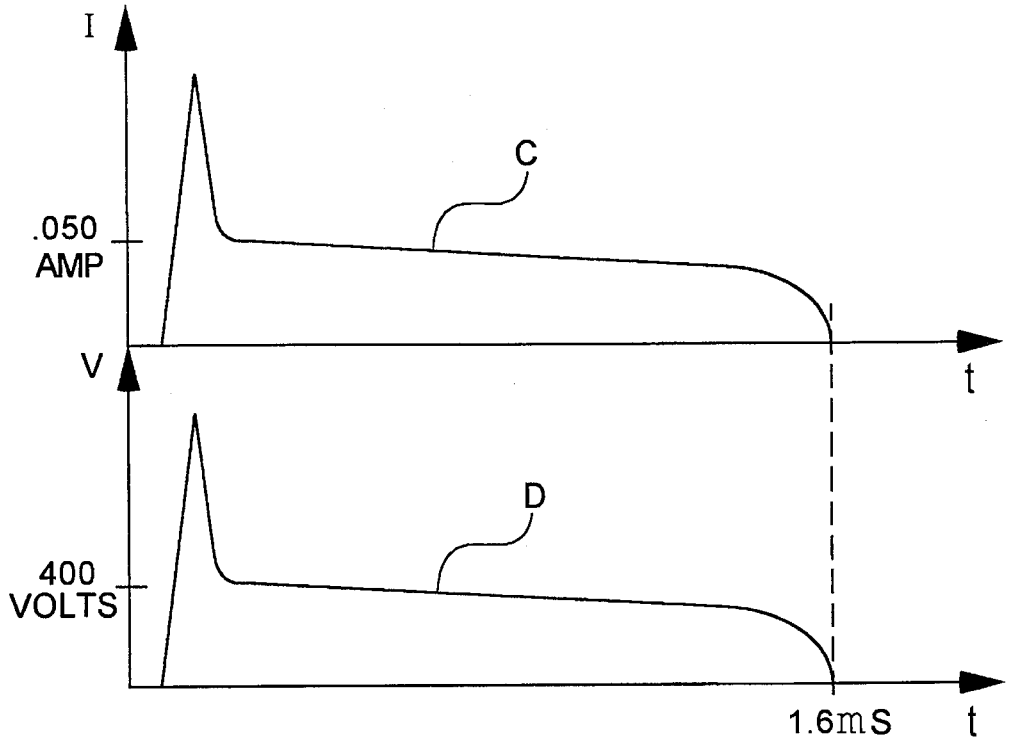
FIG. 5B is a chart depicting a low power spark voltage signal delivered to the spark plug shown in FIG. 1.

Referring now to FIG. 5A, graphs A and B depict typical current and voltage waveforms, respectively, required to produce a projected arc using the spark plug of FIG. 1 absent the magnets 32 and 34. FIG. 5B depicts the current and voltage requirements, curves C and D, respectively, of the spark plug of FIG. 1 with the magnets 32 and 34 present. Note the significant reduction in current requirements. Specifically, the current requirements in FIG. 5B curve C are significantly lower than those depicted in curve A of FIG. 5A. However, the voltage and time duration requirements in FIG. 5B, curve D, are somewhat higher than that shown in curve B. Such low current operation is less harsh on the spark plug components, significantly reduces erosion of the electrodes 26 and 28, and results in longer spark plug life.

As evident from FIGS. 5A and 5B, low current operation of the type just described requires a longer spark duration to achieve the energy required to produce the variable length arcs shown in FIG. 4. However, the substantial reduction in total energy requirement indicates the desirability of the spark plug of the present invention over the prior art.

Figure 6:
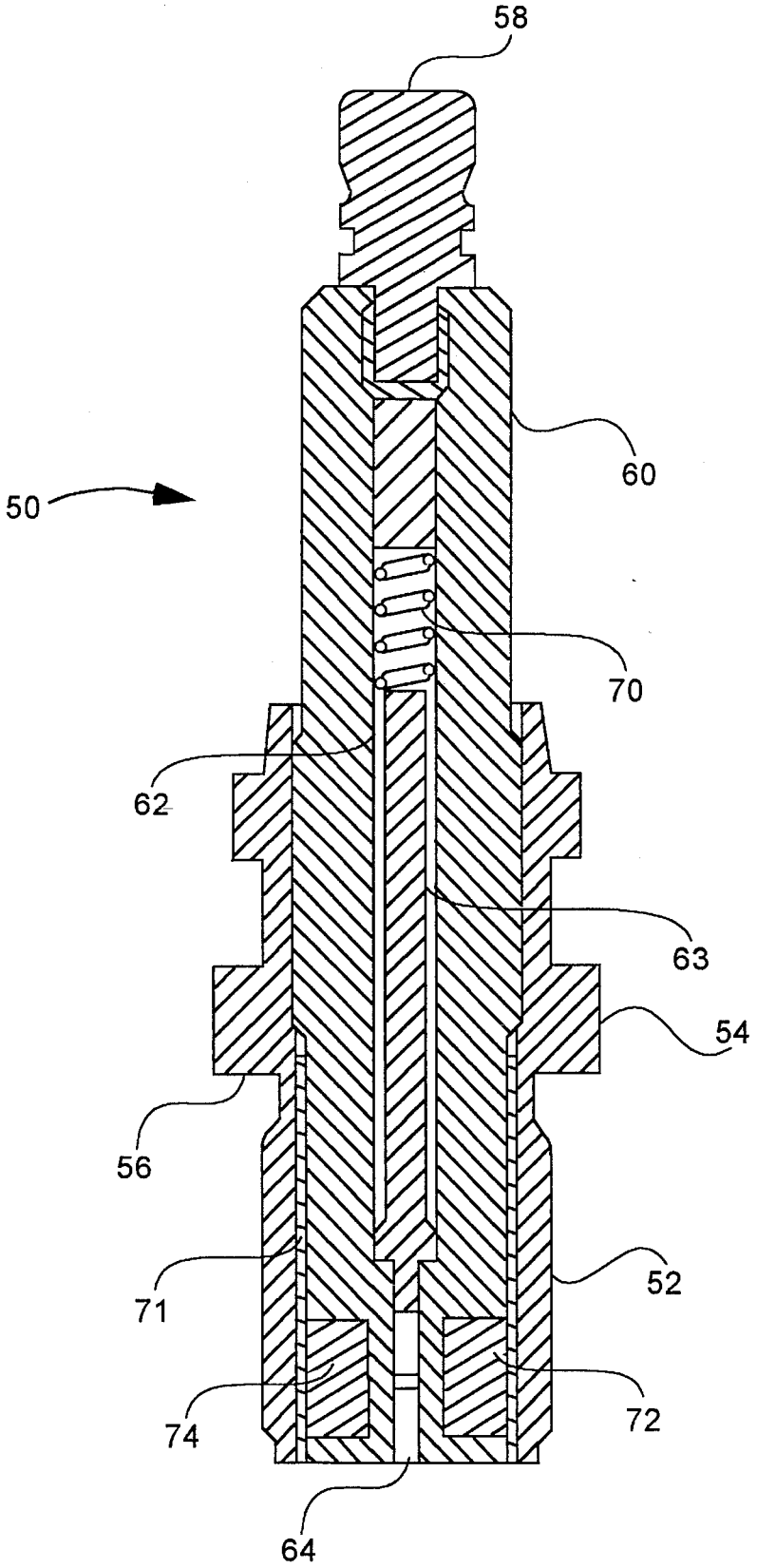
FIG. 6 is a cross-sectional view of another embodiment of a spark plug according to the present invention.
Figure 7:
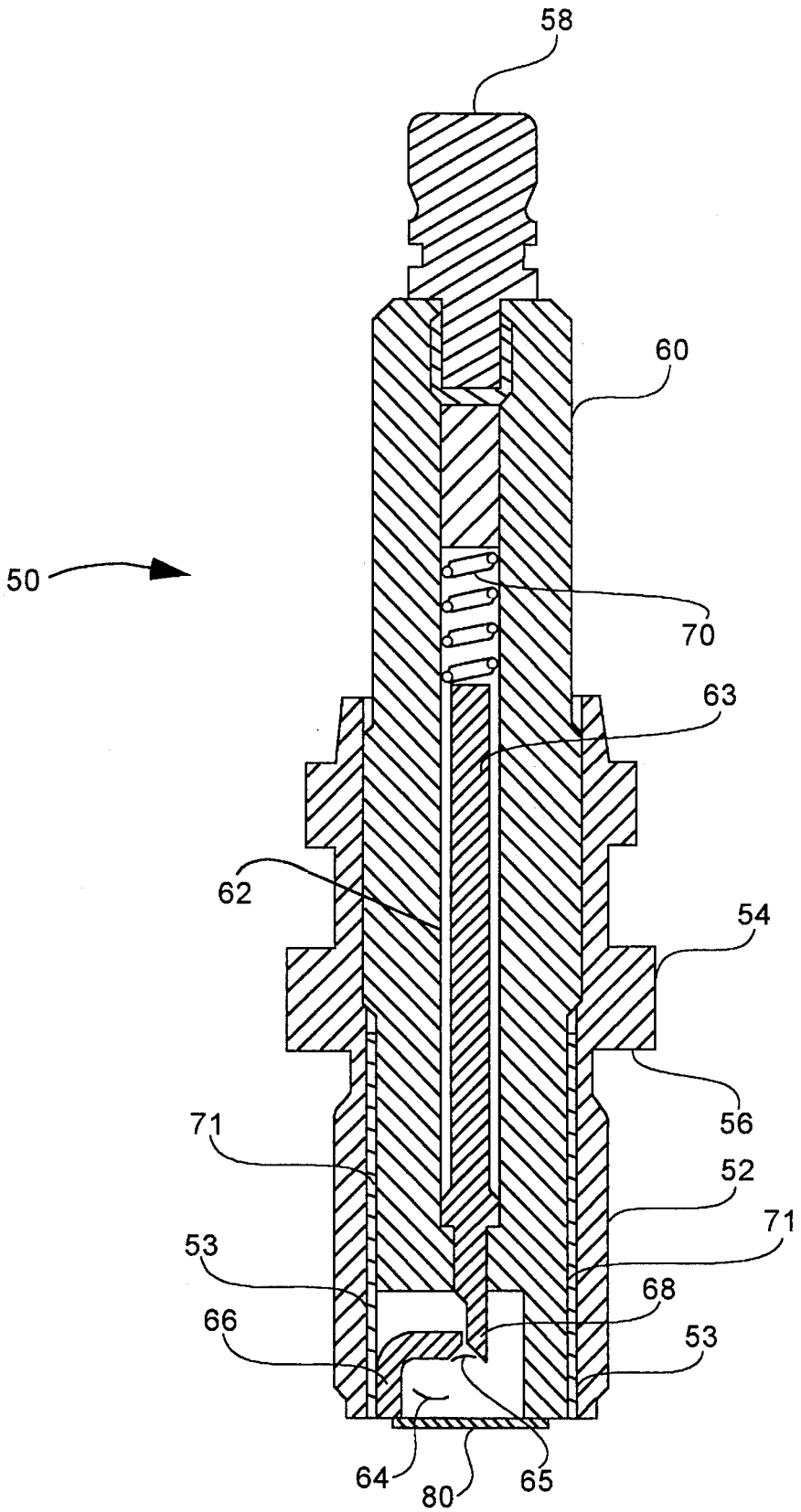
FIG. 7 is a cross-sectional view of the spark plug of FIG. 6 with the section taken along a plane perpendicular to the cross-section plane of the FIG. 6 illustration.

Referring now to FIGS. 6 and 7, a second embodiment of a spark plug 50 according to the present invention is shown. Threaded portion 52 is formed as a part of housing 54, and enables the spark plug to be securely mounted into mating threaded hole in a cylinder block (not shown). Surface 56 mates with a surface of the cylinder block or cylinder head to form an air tight seal for the combustion cavity. Other well known parts of a spark plug shown in FIGS. 6 and 7 include the electrode 58, insulator 60, a non-conducting ceramic packing powder 62 surrounding electrode 63 and a cavity 64 within which a diverging gap 65 is defined by electrode 66 and 68. Electrode 66 is attached to the inner surface of housing 54 using a brazing technique well known in the art of metalworking. Spring 70 provides an electrical connection between electrode 63 and electrode 58. Magnets 72 and 74 produce a magnetic field in the gap 65 similar to the magnetic field produced by the magnets of the embodiment of FIG. 1. The arc depicted in FIG. 4 and the discussion associated therewith are equally applicable to the results achieved with the spark plug 50. Likewise, the protective membrane 80 shown in FIG. 7 is identical in structure and operation to the membrane 80 shown in FIG. 2.

Insulator 60 is made from silicon nitride. Magnets 72 and 74 are sumarium cobalt based magnets. Housing 54 is made from materials typical in spark plug construction, such as steel or the like. Electrode 58 is made from steel or aluminum. Electrodes 66 and 68 are made from steel or similar materials resistant to arc erosion well known in the art of spark plug construction.

The functionality of the insulator 60 is two-fold in importance to the proper operation of the spark plug 50. First, the insulator prevents electrical arcing from the electrodes 66 and 68 to the magnets 72 and 74. Secondly, the insulator 60 provides a thermal isolation barrier between the cavity 64 and the magnets 72 and 74. Thermal isolation from the combustion area is necessary to ensure proper operation of the spark plug 50. Combustion chamber temperatures at the spark plug tip can reach 600–700 degrees Celsius. Since the Curie temperature of a sumarium cobalt magnet is approximately 350 degrees Celsius, the magnets must be maintained at a temperature significantly below that temperature in order for the magnetic fields produced thereby to propel and enlarge the arc generated in the gap between electrodes 66 and 68. In fact, even at temperatures as low as 150 degrees celsius, a sumarium cobalt magnet is known to experience a 50%–60% loss in magnetism.

Since insulator 60 is not a perfect thermal insulator, heat generated in the combustion area may cause the temperature of magnets 72 and 74 to rise above that of the threaded portion 52 of the housing 54. In order to draw heat away from magnets 72 and 74, heat sink sleeve 71 is positioned adjacent to the inner surface 53 of the threaded portion 52 of the housing 54. Since heat sink sleeve 71 is in simultaneous contact with both magnets 72 and 74, and the threaded housing 52, the temperature of the magnets 72 and 74 will remain substantially equivalent to the temperature of the engine block (not shown) into which threaded portion 52 is received. Although the present invention contemplates any material having high thermal conductivity as the heat sink sleeve 71, the preferred material is copper.

Prior attempts to use magnetic materials in conjunction with arc stretching have failed due to arcing and thermal breakdown problems, which problems are solved by the embodiments described above and shown in the figures.

Figure 8:
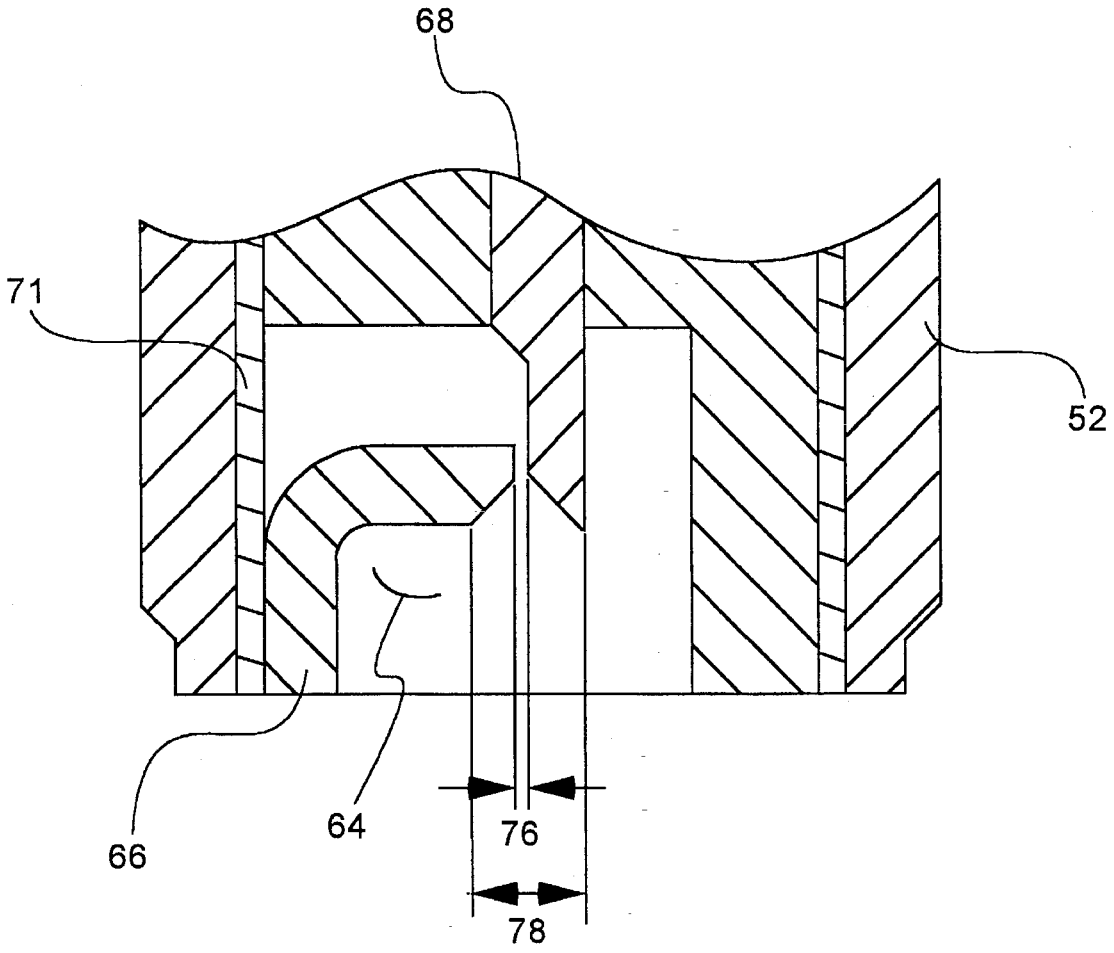
FIG. 8 is an enlarged view of the electrodes shown in FIG. 7 illustrating the configuration of the diverging spark gap.

Referring now to FIG. 8, an enlarged view of electrodes 66 and 68 are shown. The spark gap formed between electrodes 66 and 68 has a spark gap 76 that diverges to a larger spark gap 78. The various arc levels shown in FIG. 4 may be achieved with this embodiment in exactly the same fashion as described with respect to the embodiment of FIG. 4. In other words, although the embodiment shown in FIGS. 6–8 is somewhat structurally different, it operates and functions exactly the same as the embodiment shown in FIGS. 2–4.

In conventional spark plug technology, it is known that although smaller width spark gaps require less energy to form a plasma therebetween, there is a practical limitation on the minimum useful width in that there exists a gap width below which a supplemental propelling force on the plasma is required to successfully ignite the compressed fuel mixture. This minimum width is variable for each specific application and depends on the air-fuel ratio, pressure and temperature at the time of ignition. In the spark plug of FIGS. 6–8, magnets 72 and 74 supply the supplemental propelling force described above. Thus, in the preferred embodiment, the only limitation on the minimum width of spark gap 76 is the ability of the magnetic field, established by magnets 72 and 74, to propel the plasma out of the chamber 64 and ignite the compressed fuel mixture. Because of the presence of magnets 72 and 74, the maximum width of the spark gap 76 need only be that width above which plasma generated within gap 76 is propelled from the cavity 64, and capable of ignition external to cavity 64, in the absence of a supplemental propelling force. In other words, the maximum width of the spark gap 76 is that width below which plasma generated within gap 76 is propelled from the cavity 65, and capable of ignition external to the cavity 64, only in the presence of a supplemental propelling force. The only requirement on the spark gap width 78 is that it be wider than the spark gap width 76 so that a diverging gap is established therebetween.

Figure 9:
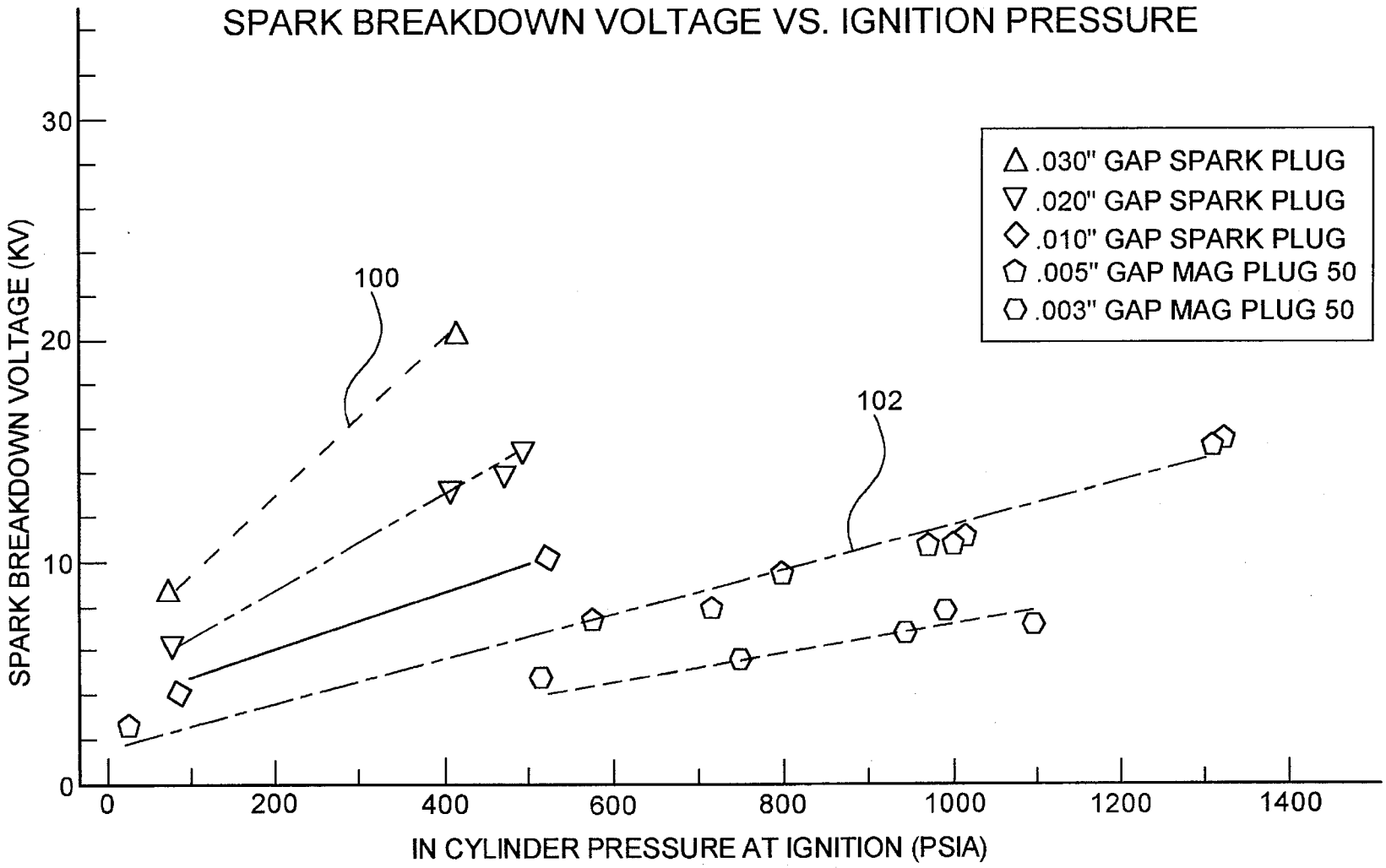
FIG. 9 is a graph showing spark breakdown voltage vs ignition pressure for a plurality of spark gap widths.
Figure 10:
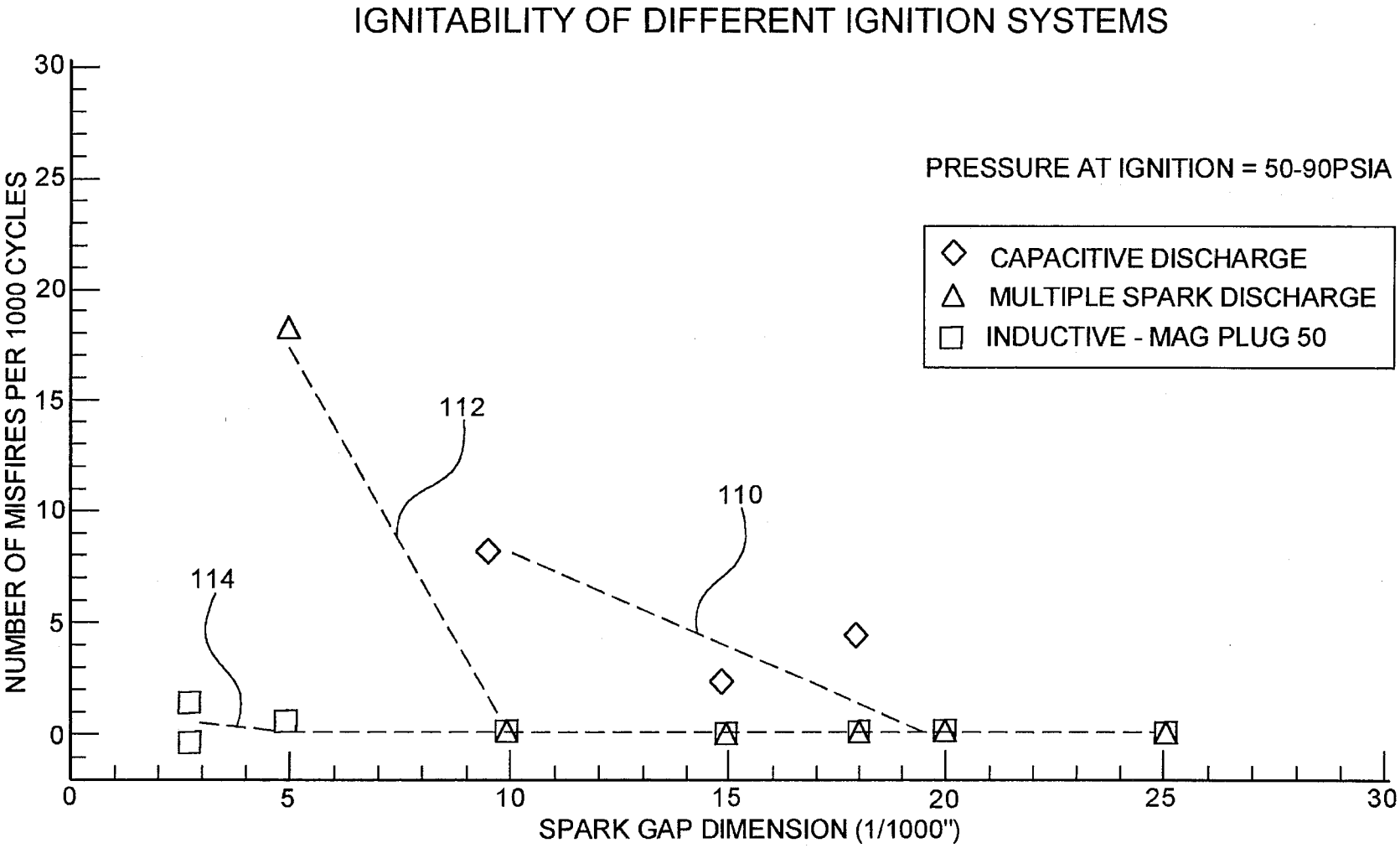
FIG. 10 is a graph showing the number of misfires per 1000 cycles as spark gap width decreases in a capacitive discharge spark plug, a multiple spark discharge spark plug and a spark plug according to the present invention.

It has been found that using a minimum spark gap 76 within the above disclosed range in the spark plug of the present invention is advantageous for at least two reasons. First, as shown in the graph of FIG. 9, the spark breakdown voltage at any given pressure decreases with the minimum spark gap 76. Thus, as the cylinder pressure increases, a smaller plug gap requires a lower voltage applied to the terminal 22 (FIG. 1) or 58 (FIGS. 7, 9 and 10) to induce a spark therein. For example, whereas a conventional spark plug having a standard 0.030 inch spark gap requires over 20 kV to induce a spark therein at 400 psi, as shown by plot data 100 of FIG. 9, the spark plug of the present invention, such as spark plug 50 shown in FIGS. 6 and 7, having a 0.005 inch spark gap requires only approximately 15 kV to induce a spark therein at approximately 1300 psi, as shown by plot data 102 of FIG. 9. Second, as shown in FIG. 10, as the spark gap width decreases in conventional spark plugs, a minimum gap width is reached below which the number of misfires increases dramatically. In capacitive discharge spark plugs, this dramatic increase in misfires occurs as spark gap widths are reduced to below approximately 0.020 inches, as shown by plot data 110 of FIG. 10, and in multiple spark discharge spark plugs, the increase occurs as spark gap widths are reduced to below approximately 0.010 inches, as shown by plot data 112 of FIG. 10. In the spark plug of the present invention such as spark plug 50 shown in FIGS. 6 and 7, however, only a slight increase in the number of misfires is observed for spark gap widths as small as 0.003 inches, as shown by plot data 114 of FIG. 10.

Figure 11:
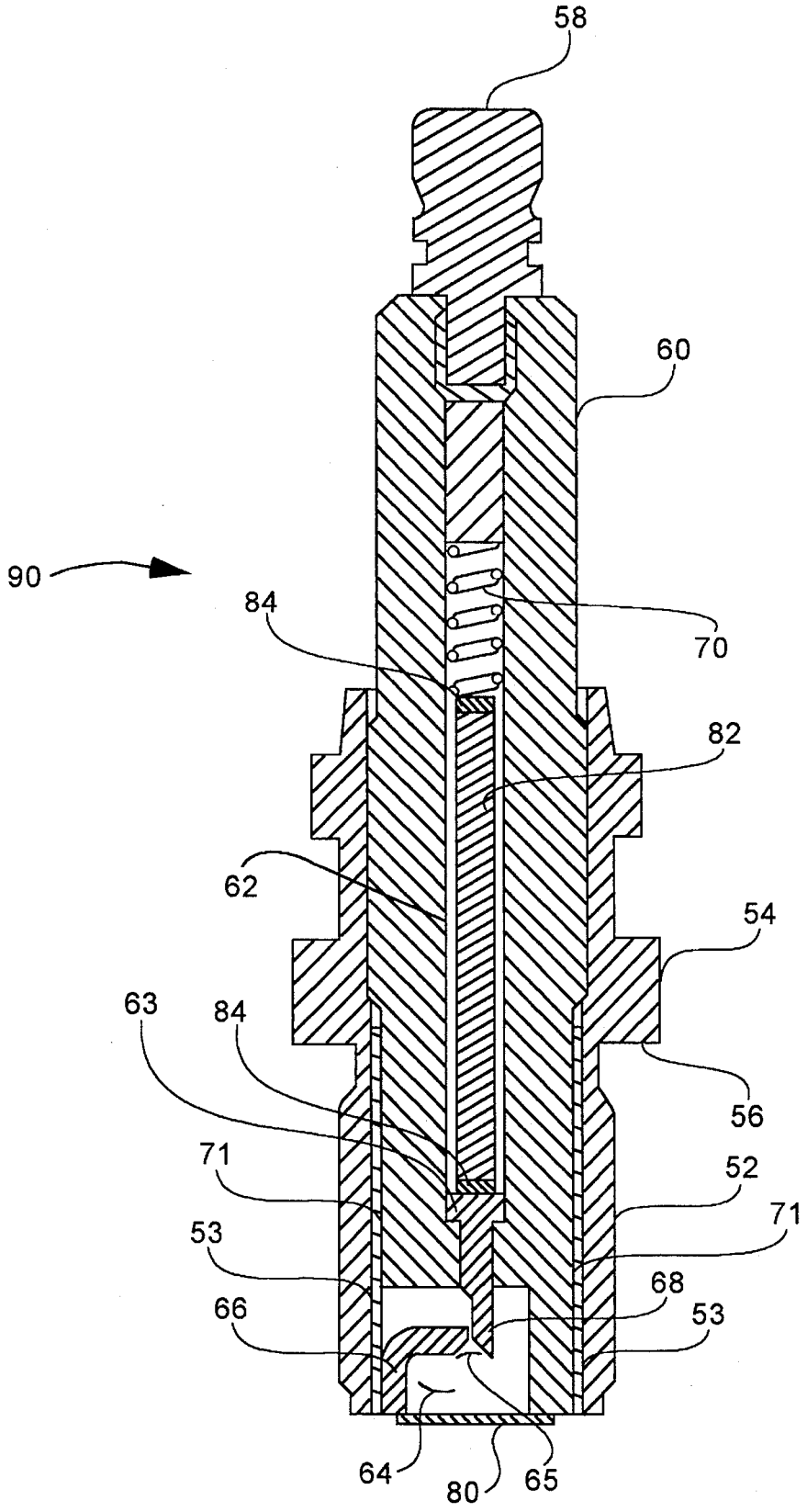
FIG. 11 is a cross-sectional view of another embodiment of a spark plug according to the present invention.
Figure 12:
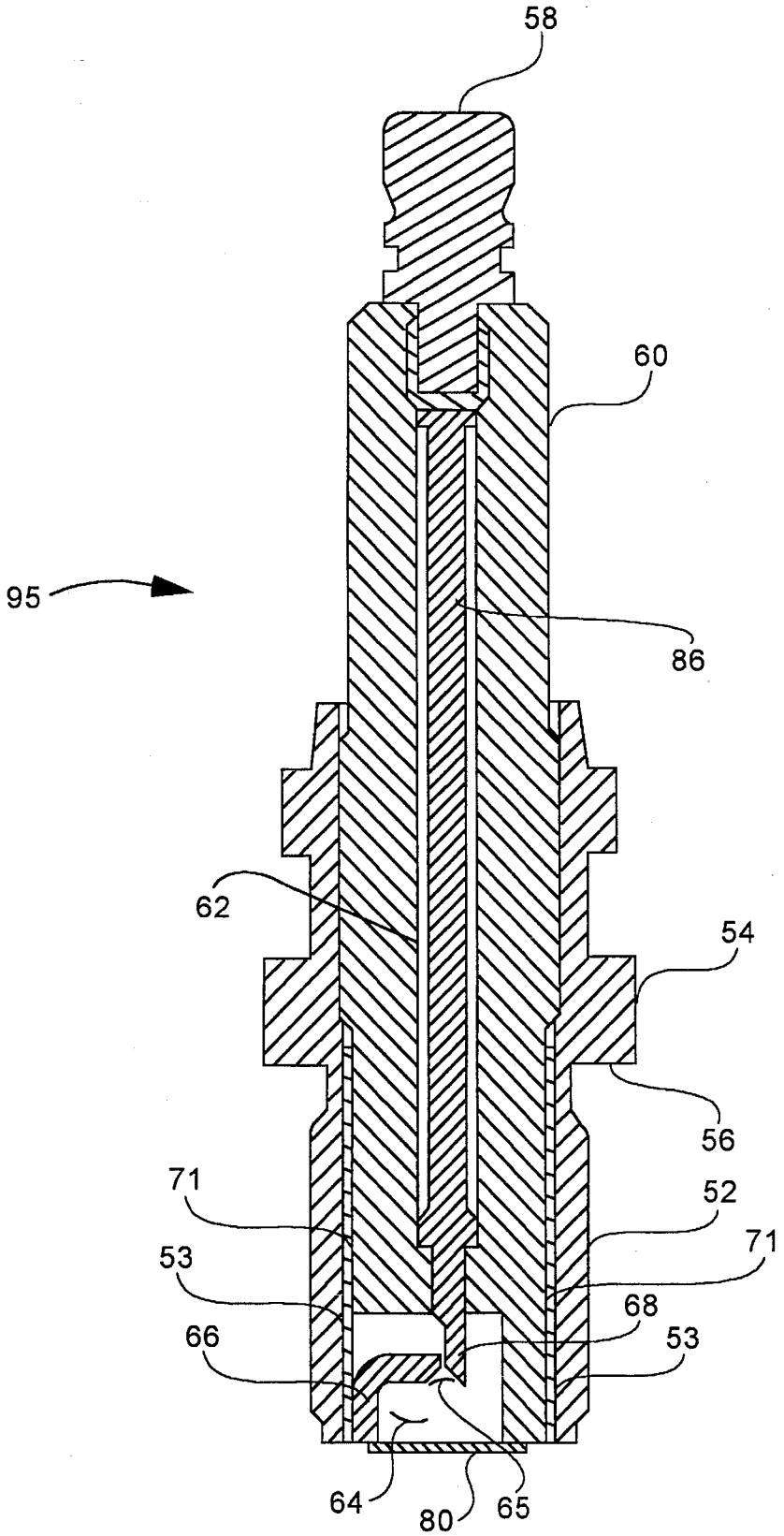
FIG. 12 is a cross-sectional view of yet another embodiment of a spark plug according to the present invention.

Referring now to FIG. 11, a further embodiment of a spark plug 90 according to the present invention is shown. Spark plug 90 is identical to spark plug 50 except that a resistor 82 is disposed between the spring 70 and electrode 63 for reducing electrical interference between the engine (not shown) and the spark plug 90. Resistor 82 is equipped with end caps 84 for providing electrical connections to the spring 70 and electrode 63. In the preferred embodiment, the value of resistor 82 may be between 1 kilo ohms and 10 kilo ohms, but the present invention contemplates resistor values as low as 500 ohms and as high as 100 kilo ohms. In an alternate embodiment of a spark plug 95 as shown in FIG. 12, the spring 70, resistor 82 and electrode 63 may be replaced by a unified electrode 86 having the desired resistance. Such a resistive electrode may be formed using conventional techniques such as, for example, sintering. In any event, either resistor embodiment may be used to achieve the same effect with the spark plug embodiment shown in FIGS. 1–3.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A spark plug device comprising:

a non-conductive substantially cylindrical shell, said shell including a first end and a second end, said first end defining a cavity therein;

a first electrode situated within said cavity;

a second electrode situated within said cavity;

magnetic field generating means attached to said shell near said cavity and producing a magnetic field, that, in conjunction with current flowing between said first and second electrode, urges a plasma arc established between said first and second electrodes in an outwardly direction from within said cavity, and wherein said shell provides electrical insulation between said first and second electrodes and said magnetic field generating means; and wherein said first and said second electrodes define a diverging gap within said cavity.

2. The device of claim 1 wherein said magnetic field generating means is a permanent magnet and wherein said shell is made from a ceramic composite.

3. The device of claim 2 wherein said shell is made from silicon nitride.

4. The device of claim 1 wherein said magnetic field generating means includes a first magnet and a second magnet arranged so that said cavity is disposed therebetween and wherein said shell is disposed between each of said first and second magnets and said first and said second electrodes.

5. The device of claim 4 wherein said shell includes first and second hollow passages extending axially within said shell and communicating with said cavity, and wherein said first and said second electrodes are situated within said hollow passages, respectively.

6. The device of claim 1 including a metallic outer shell and wherein said non-conductive shell is disposed therein and wherein said first electrode is electrically connected to said metallic shell, and wherein said magnetic field generating means is disposed between said metallic outer shell and said non-conductive shell.

7. The device of claim 6 including a heat sink means for directing heat away from said magnetic field generating means and toward said metallic outer shell, said heat sink means being disposed between, and in contact with, said metallic outer shell and said magnetic field generating means.

8. The device of claim 7 wherein said second electrode has a length and a resistance across said length of between 500 ohms and 100.0 kilo ohms.

9. A spark plug device comprising:

a non-conductive substantially cylindrical shell, said shell including a first end and a second end, said first defining a cavity therein;

a first electrode situated within said cavity;

a second electrode situated within said cavity;

magnetic field generating means attached to said shell near said cavity and producing a magnetic field, that, in conjunction with current flowing between said first and second electrode, urges a plasma arc established between said first and second electrodes in an outwardly direction from within said cavity, and wherein said shell provides electrical insulation between said first and second electrodes and said magnetic field generating means; and wherein said first and said second electrodes define a diverging gap within said cavity, said diverging gap having a first gap that diverges to a second gap, said first gap having as a maximum width that width above which said plasma arc is propelled from said cavity, and capable of ignition external to said cavity, in the absence of a supplemental propelling force, but below which said plasma arc is propelled from said cavity, and capable of ignition external to said cavity, only in the presence of said supplemental propelling force.

10. The device of claim 9 wherein said supplemental propelling force is said magnetic field.

* * * * *